US005880418A

United States Patent [19]

Livesay

[11] Patent Number: 5,880,418

[45] Date of Patent: Mar. 9, 1999

[54] METHOD AND APPARATUS FOR A MULTI-FUNCTION MANUAL CONTROLLER

[76] Inventor: L. D. Livesay, 1556 Dublin Cir., Grapevine Hills, Tex. 76051

[21] Appl. No.: 975,137

[22] Filed: Nov. 20, 1997

[51] Int. Cl.[6] ..... H01H 9/26

[52] U.S. Cl. ..... 200/5 A; 200/6 R; 200/18

[58] Field of Search ..... 84/428, 479 A, 84/485 R, 658, 662, 670, 718, 743, 626, 644; 200/1 R, 5 A, 6 R, 18; 235/145 R, 379, 380; 463/36–39

[56] References Cited

U.S. PATENT DOCUMENTS

| | | | |
|---|---|---|---|
| 4,442,506 | 4/1984 | Endfield | 364/900 |
| 4,517,424 | 5/1985 | Kroczynski | 200/52 R |
| 4,791,408 | 12/1988 | Heusinkveld | 340/365 R |
| 4,849,732 | 7/1989 | Dolenc | 341/20 |
| 4,905,001 | 2/1990 | Penner | 341/20 |
| 4,971,465 | 11/1990 | Hashimoto | 400/485 |
| 4,998,457 | 3/1991 | Suzuki et al. | 84/600 |
| 5,267,181 | 11/1993 | George | 364/709.15 |
| 5,432,510 | 7/1995 | Matthews | 341/20 |
| 5,512,892 | 4/1996 | Corballis et al. | 341/22 |
| 5,624,117 | 4/1997 | Ohkubo et al. | 273/148 B |
| 5,785,317 | 7/1998 | Sasaki | 273/148 B |

FOREIGN PATENT DOCUMENTS

| | | | |
|---|---|---|---|
| 0191897 | 8/1989 | Japan | G10H 1/053 |

*Primary Examiner*—Michael L. Gellner
*Assistant Examiner*—Nhung Nguyen
*Attorney, Agent, or Firm*—J. F. Bryan

[57] ABSTRACT

Right and left handpieces have five manually operated control switches each and are pivotally connected, face-to-face, with contactors in each handpiece face contacting contacts in the other to provide a plurality of sets of discreet signals as the handpieces are pivotally repositioned.

6 Claims, 4 Drawing Sheets

14,20

12,18

METHOD AND APPARATUS FOR A MULTI-FUNCTION MANUAL CONTROLLER

FIELD OF THE INVENTION

The present invention relates to the field of manually operated electrical control units, where the output of a large number of discreet signals is required, such as keyboards and the like, and most particularly, to such controls for hand-held use.

BACKGROUND AND SUMMARY OF THE INVENTION

Devices for manual input of control signals are common in the hardware of the electronic age. Where only a few functions are involved, a mouse, a joystick or a small arrangement of push-button switches is adequate. Where more extensive signal sets are needed, the arrangement of switches may be expanded to become a keyboard of either alpha-numeric or musical form. In an application where a hand-held controller is indicated, as in many electronic games, hardware is readily available in the form of handpieces with suitable switch actuators for a few essential functions. Extensive signal sets pose obvious ergonomic difficulties in a handheld controller since the switch actuators are necessarily smaller, and must be crowded together, making operation more difficult as their number increases. Where fingers must move from one actuator to another, tactile identification becomes increasingly difficult as size is reduced and density increases. The crowding problem is solved in some applications, such as calculators, by a keyboard "shift" selection, which assigns an alternate function to each key, to increase the available number of signals. Another way to minimize the number of keys required for an extensive signal set is the so-called "tonal" keyboard, where discreet control functions are addressed by different combinations of keys, or "chords". Although either system is acceptable, keyboard "shifting" obviously introduces yet another key for each "shift" required, while chord combinations tend to be difficult to remember and consequently intimidating. Input error frequency is also higher with the tonal system.

The object of the present invention is therefore, to provide method and apparatus for maximizing the discreet signal potential of a handheld controller while using one switch actuator per finger. It is furthermore, another object of this invention to provide a systematic arrangement of functions in a pattern that an operator can most readily commit to memory. It is yet a further object of the invention to maximize the discreet signal potential of a handheld controller in a compact, inexpensively producible and convenient form.

The present invention achieves these objectives by a method of maintaining a one switch actuator per finger relationship in a two-part, handheld unit and incorporating channel selection capability through the relative positioning of the of the two parts. In a preferred embodiment of the invention, right and left handpieces have five manually operated control switches each, and are pivotally connected, face-to-face. The contactors and contacts in each face are arranged in like, rather than mirror image, patterns so that contactors in the face of each handpiece mate with contacts in the other handpiece to provide a plurality of sets of discreet signals in successive "channels". In operation, each finger is assigned to a single switch and channel selection is achieved by selecting the angular relationship of the handpieces. Thus, ten switch actuators provide ten discreet signals per channel and three, four, five or six channels will provide a total of thirty, forty, fifty or sixty discreet control signals.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
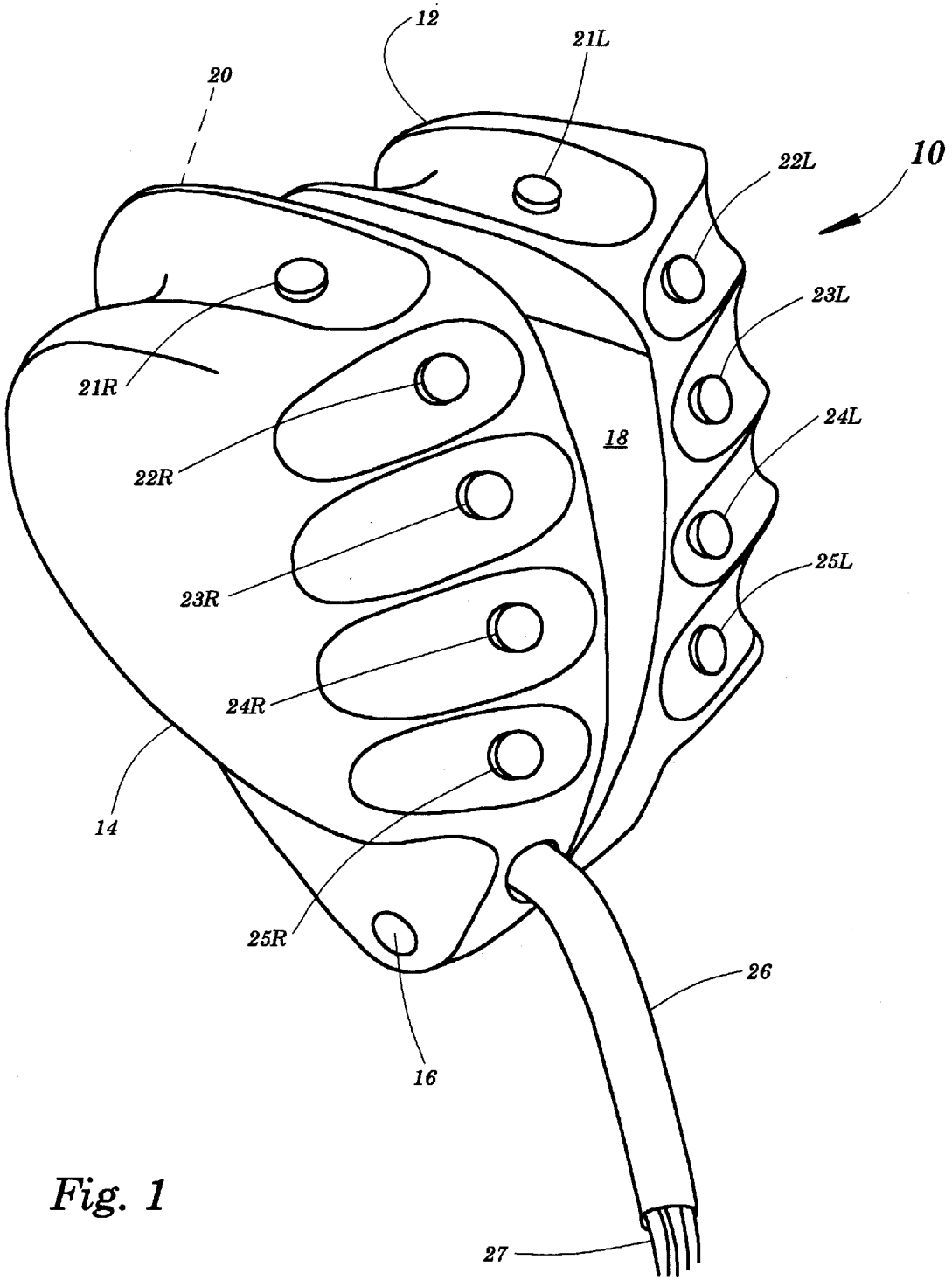
FIG. 1 shows a perspective view of the preferred embodiment of the invention.

In FIG. 1 is shown a preferred embodiment of the present invention in the form of handheld controller assembly 10. Handpieces 12 and 14 are seen to be pivotally connected by pivot pin 16 so as to permit relative angular movement while maintaining contact between their opposed faces 18 and 20. Handpiece 12 has manually actuated switches 21L, 22L, 23L, 24L and 25L, which are positioned to be actuated by the operator's left hand thumb, fore finger, middle finger, ring finger and little finger respectively. Handpiece 14 has manually actuated switches 21R, 22R, 23R, 24R and 25R, positioned to be actuated by the operator's right hand thumb, fore finger, middle finger, ring finger and little finger. Each of the operator's fingers is thus, assigned to a single actuator Also shown is cord 26, with the number of wire conductors 27 required to carry supply voltage to the controller switches and conduct discreet control signals from controller 10 as selected by the operator. Another embodiment of the present invention might be battery powered and transmit control signals by well known infra-red code technology, so as to dispense with cord 26.

Figure 2A:
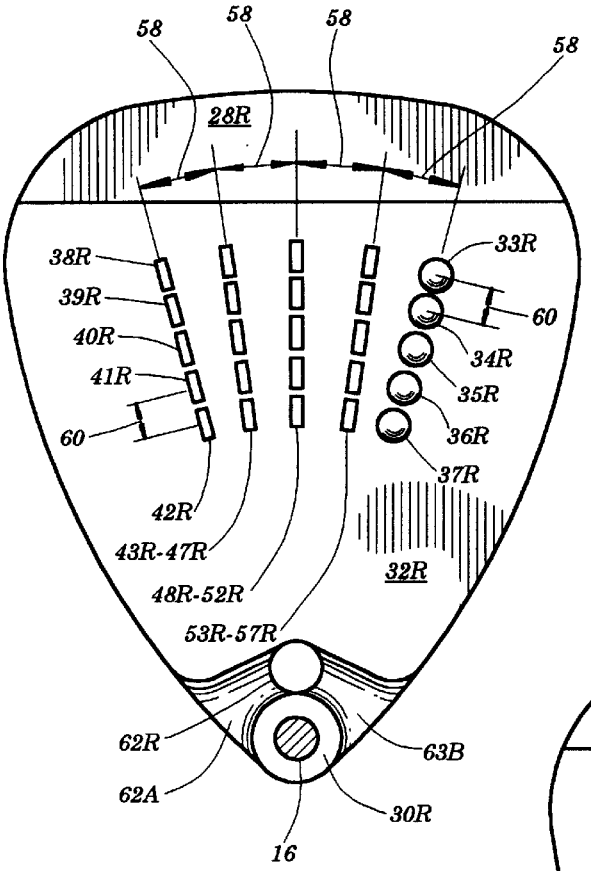
FIGS. 2A & 2B show views of the mating faces of the preferred embodiment.
Figure 2B:
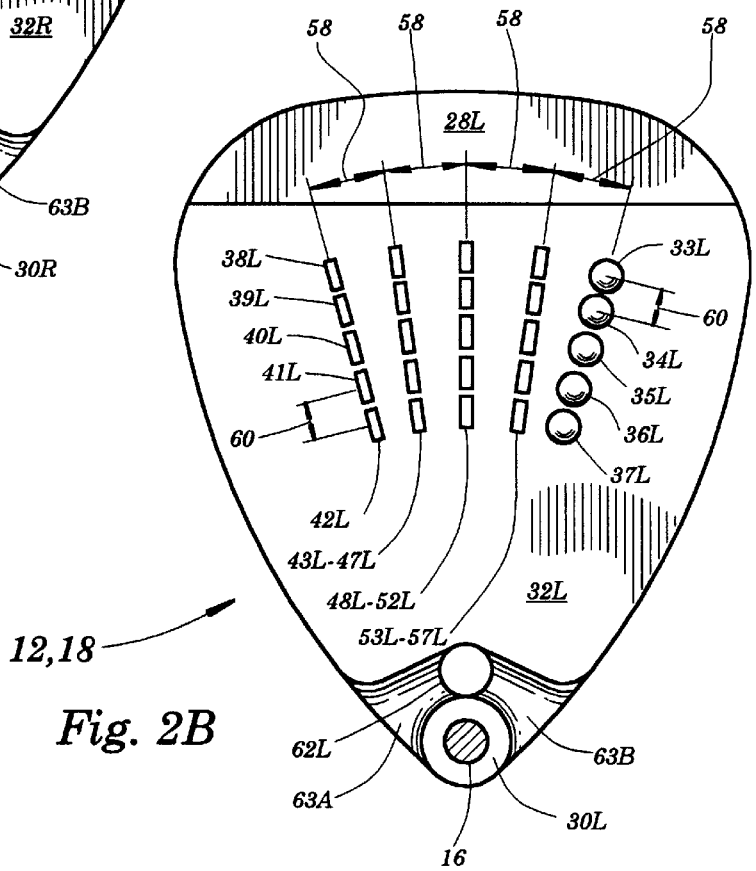

FIGS. 2A and 2B show faces 18 and 20 in detail. Although the outer portions of handpieces 12 and 14, in which actuators 21L&R through 25L&R are mounted, are shown to be mirror images in FIG. 1, it should be noted that the arrangement of faces 18 and 20 is identical. Faces 18 and 20 include central face areas 32L&R, which are slightly depressed with respect to bearing areas 28L&R and boss areas 30L&R. This serves to maintain a small working clearance dimension between face areas 32L&R in assembly as is later shown in FIG. 3. Contactors 33–37L&R are spaced apart in a row along a radius extending from pivot pin 16, as are contacts 38–42L&R of Channel I, contacts 43–47L&R of channel II, contacts 48–52L&R of channel III and contacts 53–57L&R of channel IV. Channel-to-channel and channel-to-contactor angular spaces 58 are uniform, as are contact-to-contact and contactor-to-contactor radial spaces 60 along the respective radial rows. Apertures 62L&R allow routing of wire conductors 27 into handpieces 12 and 14, as required, and reliefs 63A&B provide clearance vfor egress of cord 26 between faces 18 and 20. Placement of face 18 directly over face 20 in controller assembly 10 positions contactors 33L–37L over contacts 38R–42R of channel I and contactors 33R–37R over contacts 38L–42L of channel I.

Figure 3:
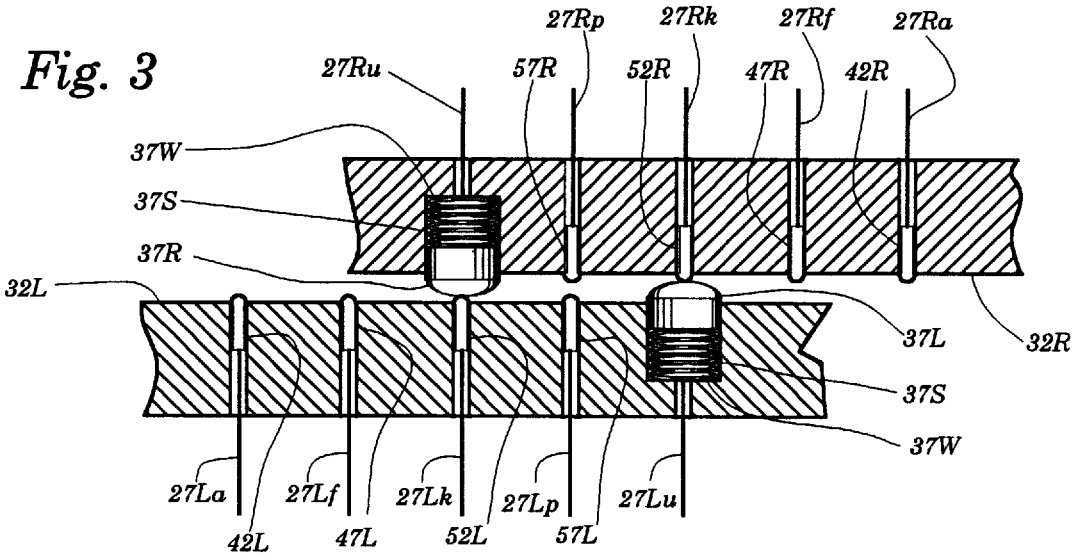
FIG. 3 shows a section view of the preferred embodiment as positioned for the selection of channel III, taken along a transverse cutting plane in FIG. 1.

FIG. 3 is a typical section view taken transversely through controller assembly 10 of FIG. 1. This particular view shows contactors 37L and 37R mating with contacts 52R and 52L of channel III. Contactors 37L&R are shown to be urged outwardly by springs 37S. Washers 37W are connected with wires 27Lu and 27Ru, and electrical continuity between these wires and contactors 37L&R is measured by the conductivity of springs 37S. As illustrated by contacts 42L&R, 47L&R, 52L&R and 57L&R, contacts 38–57L&R extend slightly above central face areas 32L&R respectively, to insure positive engagement with the contactors. As described in FIGS. 2A&B, clearance between central face areas 32L&R is maintained by bearing areas 28L&R and boss areas 30L&R. Each contact is connected with a wire 27L(R)a–t as shown in the schematic diagram of FIG. 4, which is one of the wire conductors 27 in cord 26 of FIG. 1.

Figure 4:
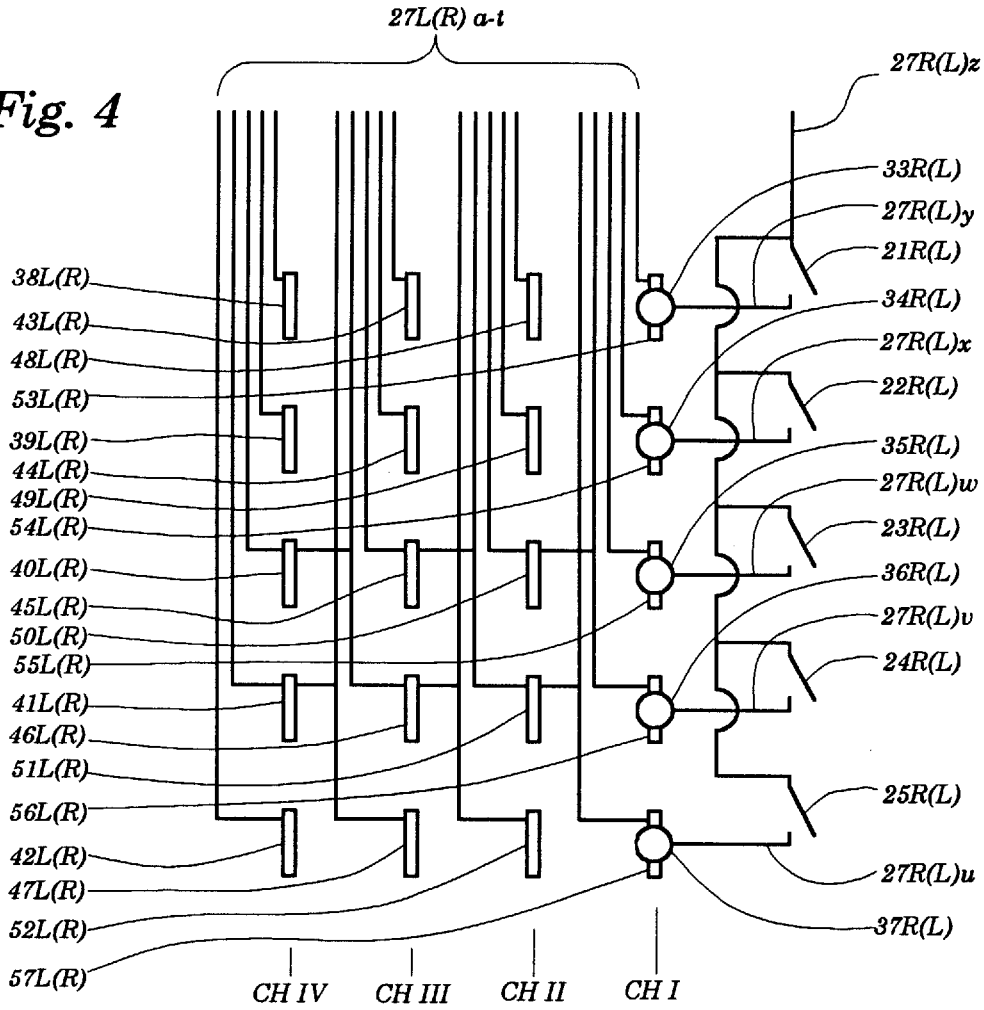
FIG. 4 shows an electrical schematic of the preferred embodiment.

FIG. 4 shows the electrical diagram of controller assembly 10 as combining the contact portion of either handpiece 12 or 14 with the contactor portion of the opposite handpiece. Thus, the contact portion of FIG.4 shows contacts 38L–57L or 38L–38R arranged as channels I–IV and contactors 33R–37R or 33L–37L and switches 21R–25R or 21L–25L, of the opposite handpiece, completing the circuit. Wires 27L(R)a–t conduct discreet control signals from controller assembly 10, according to actuator input from the operator. Wires 27R(L)z supply voltage to controller assembly 10.

Figure 5:
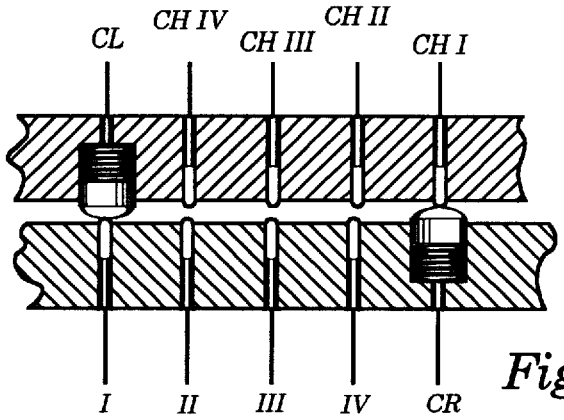
FIG. 5 shows the section view of FIG. 3 as positioned for the selection of channel I.
Figure 6:
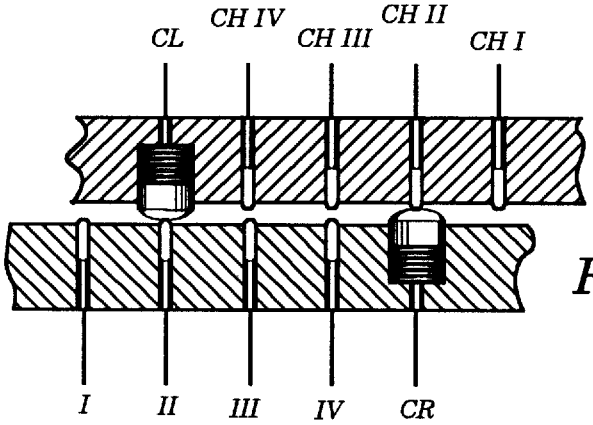
FIG. 6 shows the section view of FIG. 3 as positioned for the selection of channel II.
Figure 7:
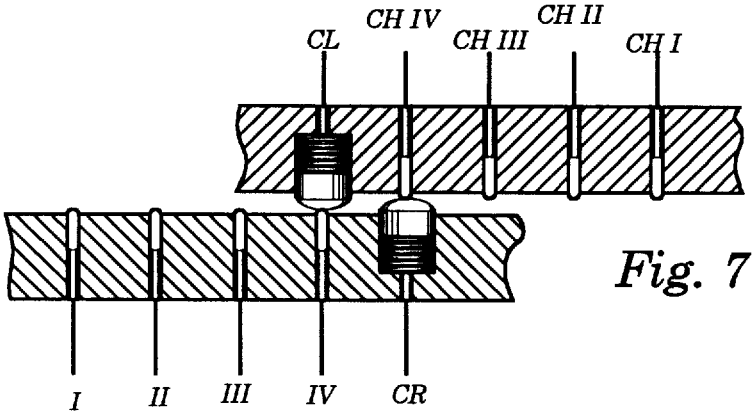
FIG. 7,shows the section view of FIG. 3 as positioned for the selection of channel IV.

FIG. 5 shows the view of FIG. 3 as it appears when handpieces 12 and 14 are pivotally re-positioned to align contactors CL and CR with the contacts of channel I (as shown in the diagram of FIG. 4), while FIGS. 6 and 7 show the alignment of contactors CL and CR with the contacts of channel II and channel IV.

Thus, the present invention utilizes a plurality of channels, according to the number of discreet control signals required for a given application. A relatively large number of discreet signals does not require memorization of complex "chording" and, the individual "one finger. one key" assignment reduces data input error potential. Moreover, this absence of finger movement between keys and the selection of channels by wrist action, rather than finger movement can provide faster input operation for systems requiring a large number of discreet signals.

It is to be understood that the present invention is not limited to the embodiment disclosed but may also be expressed in other embodiments within the spirit of the invention, through rearrangement, modification or substitution of parts.

I claim:

1. Apparatus for providing a multiplicity of discreet control signals comprising:

first and second handpieces opposed along a plane of mutual contact;

a pivotal connection to allow positioning of said handpieces along said plane of mutual contact in a plurality of discreet angular relationships;

a series of first contactors mounted in said first handpiece at said plane of mutual contact, and a series of second contactors mounted in said second handpiece at said plane of mutual contact;

a first series of first contacts mounted in said first handpiece, each said first contact contacting one of said series of second contactors when said handpieces are in a first said discreet angular relationship and a first series of second contacts mounted in said second handpiece, each said second contact contacting one of said series of first contactors when said handpieces are in said first said angular relationship; and a second series of first contacts mounted in said first handpiece, each contacting one of said series of second contactors when said handpieces are in a second said angular relationship and a second series of second contacts mounted in said second handpiece, each contacting one of said series of first contactors when said handpieces are in said second said angular relationship.

2. Apparatus for providing a multiplicity of discreet control signals according to claim 1 and further comprising:

a third series of first contacts mounted in said first handpiece, each contacting one of said series of second contactors when said handpieces are in a third said angular relationship and a third series of second contacts mounted in said second handpiece, each contacting one of said series of first contactors when said handpieces are in said third said angular relationship.

3. Apparatus for providing a multiplicity of discreet control signals according to claim 2 and further comprising:

a fourth series of first contacts mounted in said first handpiece, each contacting one of said series of second contactors when said handpieces are in a fourth said discreet angular relationship and a fourth series of second contacts mounted in said second handpiece, each contacting one of said series of first contactors when said handpieces are in said fourth said discreet angular relationship.

4. Apparatus for providing a multiplicity of discreet control signals comprising:

a first handpiece including a series of first manually operable switches and a planar first face;

a series of first contactors mounted in said first face, each said first contactor being connected to a separate first switch;

a plurality of sets of first contacts mounted in said first face;

a second handpiece including a series of second manually operable switches and a planar second face;

a series of second contactors mounted in said second face, each said second contactor being connected to a separate second switch;

a plurality of sets of second contacts mounted in said second face;

connecting means joining said first handpiece to said second handpiece for relative movement with respect thereto so that said first face is adjacently parallel and opposed to said second face in a first position, with each of said first contactors in contact with one of a first set of second contacts and each of said second contactors in contact with one of a first set of first contacts; and means for repositioning of said first handpiece relative to said second handpiece in a second position with each of said first contactors in contact with one of a second set of second contacts and each of said second contactors in contact with one of a second set of first contacts.

5. Apparatus for providing a multiplicity of discreet control signals according to claim 4 and further comprising:

means for repositioning of said first handpiece relative to said second handpiece in a third position with each of said first contactors in contact with one of a third set of said second contacts and each of said second contactors in contact with one of a third set of said first contacts.

6. A method for manual selection of a multiplicity of discreet control signals comprising the steps of:

providing an interconnected controller handpiece for each hand, said handpieces including a set of a given number of control switches;

designating an individual finger for actuation of each switch of said set of a given number of control switches by finger movement;

providing a plurality of signal output channels, each said channel for communicating the output of said set of a given number control switches to a selected set of an equal number of discreet functions; and selecting a said signal output channel for communication of a control switch signal to a selected discreet function by moving one hand relative to the other.

* * * * *

UNITED STATES PATENT AND TRADEMARK OFFICE

CERTIFICATE OF CORRECTION

PATENT NO. : 5,880,418
DATED : March 9, 1999
INVENTOR(S) : L. D. Livesay

It is certified that error appears in the above-indentified patent and that said Letters Patent is hereby corrected as shown below:

Column 3, line 1, delete "vfor" and insert "for".

Column 3, line 12, delete "measured" and insert "maintained".

Column 3, line 27, delete "38L-38R" and insert "38R-57R".

Signed and Sealed this

Sixteenth Day of November, 1999

*Attest:*

*Attesting Officer*

Q. TODD DICKINSON

*Acting Commissioner of Patents and Trademarks*